US005217407A

United States Patent [19]

Bailey

[11] Patent Number: 5,217,407

[45] Date of Patent: Jun. 8, 1993

[54] FIRE DAMPER WITH AUXILIARY SPRINGS

[75] Inventor: William J. Bailey, Louisburg, Kans.

[73] Assignee: Tomkins Industries, Inc., Dayton, Ohio

[21] Appl. No.: 714,002

[22] Filed: Jun. 11, 1991

[51] Int. Cl.[5] ..... F24F 11/00

[52] U.S. Cl. ..... 454/257; 454/369; 160/1; 126/287.5

[58] Field of Search ..... 126/287.5, 285 R; 160/1, 34, 35, 232, 84.1; 454/194, 369, 257

[56] References Cited

U.S. PATENT DOCUMENTS

| | | | |
|---|---|---|---|
| 2,287,262 | 6/1942 | Merry | 126/287.5 X |
| 3,082,759 | 3/1963 | David et al. | 126/546 |
| 3,165,050 | 1/1965 | Johnson | 126/287.5 X |
| 3,312,159 | 4/1967 | Shepherd | 126/287.5 X |
| 3,899,156 | 8/1975 | McCabe | 251/303 |
| 4,333,392 | 6/1982 | Nailor et al. | 454/369 |
| 4,763,711 | 8/1988 | Hart et al. | 454/369 X |
| 4,936,287 | 6/1990 | Hart et al. | 126/287.5 |

*Primary Examiner*—Larry Jones

[57] ABSTRACT

A fire damper comprising a plurality of interconnected blades is provided with a pair of primary negator type springs which are attached to the leading blade and a pair of auxiliary negator type springs which are attached to an intermediate blade. The blades are normally maintained in a folded condition with the springs exerting a biasing force urging movement of the blades to an extended closed position. Upon release of the blades in response to detection of fire or smoke conditions, the springs cooperate to move the blade assembly to the completely closed position. The auxiliary springs increase the rate of closing of the assembly and facilitate unfolding of a portion of the blade assembly to enhance the closing of the assembly even under high air flow conditions.

17 Claims, 1 Drawing Sheet

FIRE DAMPER WITH AUXILIARY SPRINGS

BACKGROUND OF THE INVENTION

This invention relates generally to closures for air ducts and, more particularly, to closures of the type having a hingedly interconnected blade assembly movable from a folded to an unfolded position.

Fire damper closures are mounted in the ducts or passageways in buildings and are automatically or manually operable to close off the duct or passage in the event of fire or smoke conditions. Fire damper closures conventionally comprise a plurality of blades which are hingedly interconnected into an assembly which is normally maintained in a folded condition and then unfolded in response to detection of smoke or excessive heat.

It has been found desirable in conventional fire damper closures to construct the blade assembly in a manner so that the blades rotate relative to each other less than 180° upon closing of the assembly to the unfolded position. Such a construction offers advantages in strength and also facilitates resetting of the blades to the folded position. It has been recognized, however, that the limited rotation of the blades may result in a "spring action" which does not assure positive closing of the assembly. This problem has previously been overcome with a blade assembly of the type disclosed in U.S. Pat. No. 3,907,020 wherein the blades are interconnected in a manner which provides a positive stop to limit the degree of opening. The blade assembly disclosed in that patent also employs negator type coiled springs secured to the leading blade to assist with closing of the blade assembly.

When closure of the above described blade assembly is unaided by gravitational forces, the application of a biasing force to the leading or endmost blade of a foldable blade assembly is often insufficient to ensure complete closing of the blade assembly under high air flow conditions. It has been determined by the present inventor that at least two factors contribute to impede full closure of the assembly. First, the blades in the leading portion of the assembly tend to unfold to their maximum permitted orientation in response to air flow and pressure directed against those blades while the remaining blades remain in the folded position. As a result, the folded portion of the blade assembly is not drawn into the air flow where the pressure applied to those blades would otherwise contribute to unfolding and closing of the blade assembly. Second, the rate at which the blades unfold is impeded by the air flow and pressure which forces the unfolded blades against the damper frame. The additional frictional force of the blades moving along the damper frame then prevents the spring biasing force from completely closing the blade assembly. Despite attempts to increase, even double, the spring force exerted on the leading blade, complete closure of the blade assembly could not be reliably achieved with conventional spring assisted closure constructions.

SUMMARY OF THE INVENTION

It is a primary object of this invention to provide, in a fire damper having a foldable blade assembly and a biasing spring which is connected to the leading blade, an auxiliary spring which exerts a biasing force to an intermediate blade so that a more uniform unfolding of the assembly is provided to more reliably achieve complete closing of the blade assembly.

It is another object of this invention to provide a fire damper having a foldable blade assembly with a spring biasing means which will deploy the blade assembly to the closed position at a rate which reduces the frictional effect caused by the blades being forced against the damper frame so that complete closure of the assembly is more reliably accomplished.

It is also an object of this invention to provide a fire damper having an articulated, foldable blade assembly with a spring which exerts a biasing force to an intermediate blade of the assembly to initiate unfolding of that portion of the assembly on which the force acts so that air flow and pressure may act on said assembly portion to contribute to complete extension and closing of the entire blade assembly.

To accomplish these and other related objects of the invention, a fire damper is provided comprising a housing which defines an opening, a plurality of interconnected blades connected with the housing and movable between a folded and an unfolded position, means for holding said blades in said folded position and releasing said blades in response to fire conditions, a first spring means coupled with a leading blade for exerting a biasing force on the leading blade to urge movement of the blades to the unfolded position, and a second spring means coupled with an intermediate blade for urging movement of the blades to the unfolded position.

BRIEF DESCRIPTION OF THE DRAWINGS

In the accompanying drawings which form a part of the specification and are to be read in conjunction therewith and in which like reference numerals are used to indicate like parts in the various views.

DESCRIPTION OF THE PREFERRED EMBODIMENT

Figure 1:
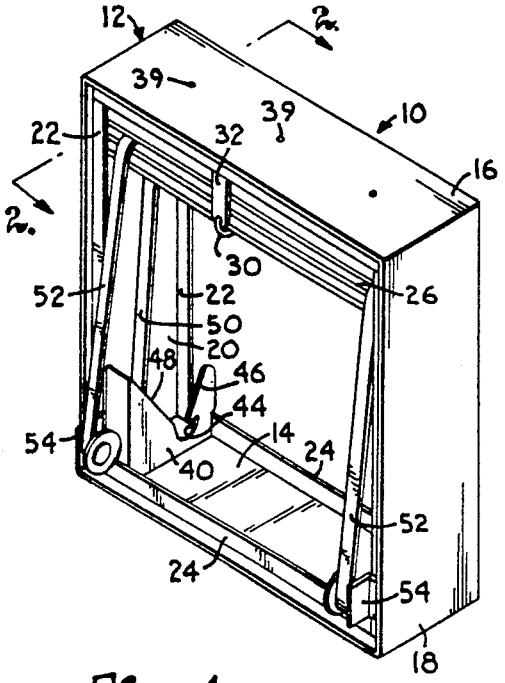
FIG. 1 is a perspective view of a fire damper constructed in accordance with the present invention and showing a blade assembly disposed in a folded position.

Referring now to the drawings in greater detail and initially to FIG. 1, a fire damper of the present invention which is adapted to be placed in a building duct or passage is represented broadly by the numeral 10. Damper 10 includes a framework 12 formed from sheet metal or similar material. Framework 12 has a generally rectangular configuration with opposed end walls 14 and 16 and side walls 18 and 20 that define an opening through which air flows when the damper is installed in the building duct.

The side walls 18 and 20 of the damper both include spaced apart channel defining flanges 22 which are formed by folding over the edges of the side walls and then folding each edge at an angle of 90° from the plane of the respective side wall. Stiffening flanges 24 are formed in the same manner on end walls 14 and 16.

A plurality of blades 26 are interconnected to form a blade assembly which is normally maintained in a folded condition within the framework 12 by a fusible link 28 or other suitable means. The fusible link 28 is coupled by a pair of S-hooks 30 to a U-bracket 32 which is mounted to end wall 14 in a suitable fashion.

The blades 26 substantially span the distance between side walls 18 and 20 and are interconnected in a manner which prevents relative rotation of greater than 180° between adjacent blades. Each blade comprises a planer intermediate portion 34 and a first incomplete generally cylindrical portion 36 along one edge and a second incomplete generally cylindrical portion 38 along the other edge. The first and second cylindrical portions 36 and 38 are sized so that the first cylindrical portion of one blade interconnects with the second cylindrical portion of the immediately adjacent portion in a manner such as is more fully described in U.S. Pat. No. 3,907,020, which is incorporated herein in its entirety. The blade assembly is coupled with the damper by rivets 39 which secure the first or end blade to the end wall 16.

A pair of spaced apart blade catch components 40 are mounted by rivets 42 to end wall 18 and extend in the direction of opposed end wall 16. Both blade catch components 40 include a blade catch 44 and first and second surfaces 46 and 48 which cooperate to guide the incomplete cylindrical portion 38 of the leading blade into the blade catch 44 and thereby lock the blade assembly in the unfolded position.

Both blade catch components 40 mount a negator type coiled spring 50 within the opening defined by damper framwork 12. Springs 50 serve to exert a primary biasing force onto the leading blade which urges the blade assembly toward the unfolded position. The springs 50 extend entirely within the opening in the direction of the opposite end wall 16 and are riveted to the intermediate portion 34 of the leading blade 26. The springs are preferably positioned off center on the intermediate portion of the leading blade and are placed near the edges of the leading blade.

All of the heretofore described parts of fire damper 10 are of generally conventional construction. The novelty of the present invention resides in the provision of auxiliary negator type coiled springs 52 which are mounted on brackets 54 to exert an additional biasing force on the blade assembly at a location which facilitates uniform unfolding and complete closing of the assembly. The brackets which mount auxiliary springs 52 are positioned on the channel defining flanges 22 near end wall 14 and exteriorly of the channel defined by the flanges. Springs 52 extend from their mounting brackets toward the opposite end wall 16 and are connected to an intermediate blade in the blade assembly. A substantial portion of the extended springs 52 is located outside of the channel defined between flanges 22. The intermediate blade to which springs 52 are attached is preferably the middle blade or an immediately adjacent blade in the assembly but it is to be understood that the intermediate blade may include other blades to which the application of the auxiliary spring biasing force will assist in achieving complete closure of the blade assembly. The springs are preferably connected to the intermediate blade at an off centered position on the planer intermediate portion 34 of the blade and near the edges thereof.

Figure 2:
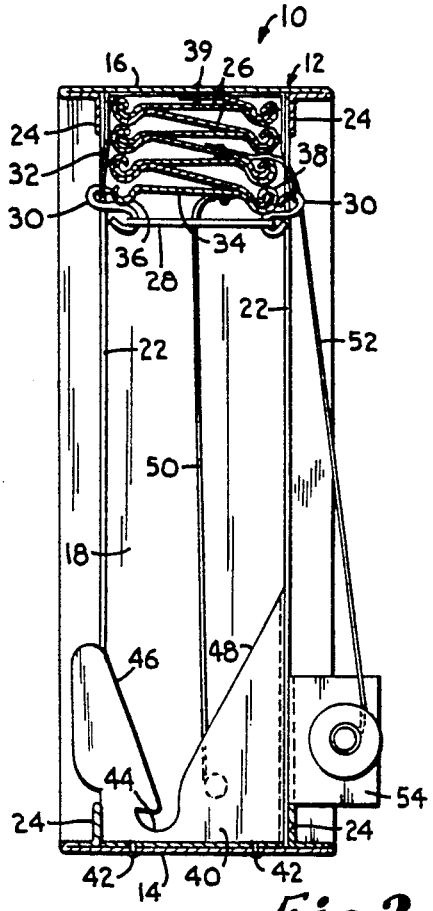
FIG. 2 is a side elevational view of the fire damper, taken in vertical section along line 2—2 of FIG. 1 to illustrate the attachment of the springs to the blade assembly.
Figure 3:
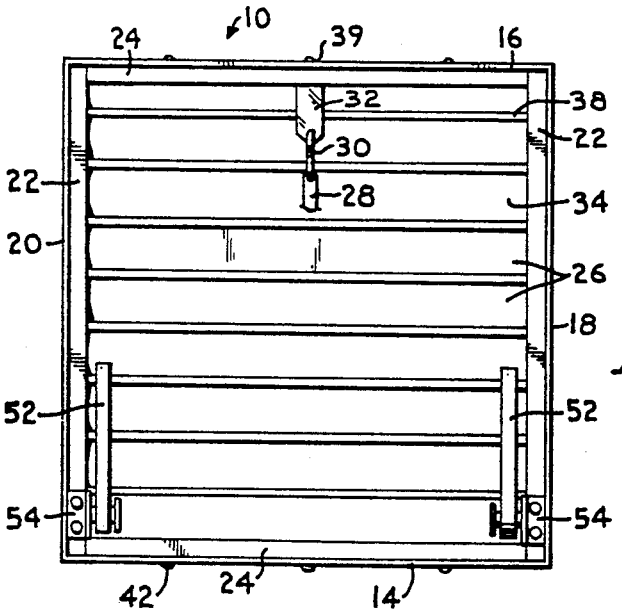
FIG. 3 is a fragmentary top plan view of the fire damper shown in FIG. 1 but with the blade assembly unfolded to its completely closed position.

In response to detection of fire or smoke conditions and release of the fusible link 28, the blade assembly is rapidly moved by springs 50 and 52 from its folded position as illustrated in FIGS. 1 and 2 to a completely closed position as illustrated in FIG. 3. In its completely closed position the blade assembly serves to block passage of smoke and fire through the damper 10 and the vertically or horizontally extending passage in which it is placed.

Complete closure of the blade assembly is accomplished with the combination of springs 50 and 52 acting on different portions of the blade assembly. The biasing force exerted by primary springs 50 on the leading blade 26 is transmitted to the remaining blades as a result of their interconnection, while the biasing force exerted by the auxiliary springs 52 is directed principally to the intermediate blade and those blades connected between the intermediate blade and the end blade which is fastened to the damper end wall 16. The exertion of a biasing force directly on the intermediate blade by auxiliary springs 52 acts to unfold that portion of the assembly lying between the intermediate blade and the endmost blade. The auxiliary springs thus ensure a more uniform unfolding of the blade assembly, even at air flow rates that would normally result in unfolding of only the leading portion of the assembly. This uniform unfolding is particularly important to successful closure of the blade assembly as it exposes more of the blades to the air flowing through the damper. The air flow then exerts a pressure on these additional blades to urge them toward the unfolded position. The greater blade exposure provided by more complete unfolding of the blade assembly thereby greatly facilitates maximum extension and complete closure of the blade assembly.

The auxiliary springs 52 also provide a higher rate of unfolding of the blade assembly than can be achieved with primary springs 50 alone. The higher unfolding rate is particularly advantageous in that it reduces the contact time of the blades with the channel flanges 22 and thereby lessens the frictional resistance which acts to restrain complete extension of the blade assembly. Complete closure of the blade assembly is more reliably achieved as a result of this higher unfolding rate, even at air flow rates 50 to 100% greater than the maximum flow rates for which conventional fire dampers have been able to achieve complete closure.

It can thus be seen that by directing a biasing force to an intermediate portion of the blade assembly to provide a more rapid and uniform extension of the assembly, complete closure of the assembly can be achieved even at elevated air flow rates.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A fire damper comprising:

a housing which defines an opening;

a plurality of interconnected blades connected with the housing and movable between a folded position at one end of the housing and an unfolded position wherein the blades block said opening, said blades including an end blade which is coupled with the housing, a leading blade, and an intermediate blade positioned between the end and leading blades;

first means for holding said blades in said folded position and releasing said blades in response to fire conditions;

a first spring means coupled with the leading blade for exerting a biasing force on the leading blade to urge movement of the blades to the unfolded position;

a second spring means coupled with the intermediate blade for exerting a biasing force on the intermediate blade to urge movement of the blades to the unfolded position; and second means for holding the blades in the unfolded position.

2. The fire damper as set forth in claim 1, wherein said second spring means comprises a pair of spaced apart springs connected to the intermediate blade.

3. The fire damper as set forth in claim 2, wherein the springs comprise negator type coiled springs.

4. The first damper as set forth in claim 3, wherein said first spring means comprises a pair of spaced apart springs connected to the leading blade.

5. The first damper as set forth in claim 4, wherein the springs connected to the leading blade comprise negator type coiled springs.

6. The fire damper as set forth in claim 5, wherein said second means for holding the blades in the unfolded position comprises a blade catch which interlocks with the leading blade when the blades are in the unfolded position.

7. A fire damper comprising:

a housing which defines an opening;

a plurality of interconnected blades connected with the housing and movable between a folded position at one end of the housing and an unfolded position wherein the blades block said opening, said blades including an end blade which is coupled with the housing, a leading blade, and an intermediate blade positioned between the end blade and leading blade;

means for holding said blades in said folded position and releasing said blades in response to fire conditions;

a blade catch which interlocks with the leading blade when the blades are in the unfolded position;

a primary spring coupled with the leading blade for exerting a biasing force on the leading blade to urge movement of the blades to the unfolded position; and an auxiliary spring coupled with the intermediate blade for exerting a biasing force on the intermediate blade to urge movement of the blades to the unfolded position.

8. The first damper as set forth in claim 7, including a second primary spring connected to the leading blade for exerting a biasing force on the leading blade to urge movement of the blades to the unfolded position.

9. The fire damper as set forth in claim 8, wherein the primary springs comprise negator type coiled springs.

10. The fire damper as set forth in claim 9, including a second auxiliary spring connected to the intermediate blade to urge movement of the blades to the unfolded position.

11. The fire damper as set forth in claim 10, wherein the auxiliary springs comprise negator type coiled springs.

12. The fire damper as set forth in claim 11, wherein said means for holding the blades in the folded position comprises a fusible link.

13. A fire damper comprising:

a housing which defines an opening;

a plurality of interconnected blades having an end blade which is connected with the housing, a leading blade and a plurality of intermediate blades positioned between the end and leading blades, said interconnected blades being movable between a folded position at one end of the housing and an unfolded position wherein the blades extend to an opposite end of the housing to block said opening;

a catch for holding said blades in said folded position, said catch being operable in response to fire conditions to release said blades;

a fire biasing member coupled with the leading blade for exerting a biasing force on the leading blade to urge movement of the blades to the unfolded position;

a second biasing member coupled with one of the intermediate blades for facilitating complete unfolding of said blade by exerting a biasing force on said one intermediate blade to urge movement of the blades to the unfolded position; and means for holding the blades in the unfolded position.

14. The fire damper as set forth in claim 13, wherein said first and second biasing members comprise negator type coiled springs.

15. The fire damper as set forth in claim 14, wherein said catch comprises a fusible link.

16. The first damper as set forth in claim 14, wherein said first biasing member comprises a pair of said negator type coiled springs.

17. The fire damper as set forth in claim 16, wherein said second biasing member comprises a pair of said negator type coiled springs.

* * * * *

UNITED STATES PATENT AND TRADEMARK OFFICE

CERTIFICATE OF CORRECTION

PATENT NO. : 5,217,407

DATED : June 8, 1993

INVENTOR(S) : William J. Bailey

It is certified that error appears in the above-identified patent and that said Letters Patent is hereby corrected as shown below:

Column 5, line 22 of the patent, delete "first" and insert --fire--.

Column 5, line 25 of the patent, delete "first" and insert --fire--.

Column 6, line 47 of the patent, delete "first" and insert --fire--.

Signed and Sealed this

Eighteenth Day of January, 1994

*Attest:*

Bruce Lehman

BRUCE LEHMAN

*Attesting Officer*

*Commissioner of Patents and Trademarks*